US010418197B2

(12) United States Patent
Rojko et al.

(10) Patent No.: US 10,418,197 B2
(45) Date of Patent: Sep. 17, 2019

(54) CIRCUIT BREAKER ACCESSORY COVER INTERLOCK AND FORCED SAFETY TRIPPING APPARATUS, SYSTEMS, AND METHODS

(71) Applicant: Siemens Aktiengesellschaft, München (DE)

(72) Inventors: Jan Rojko, Conyers, GA (US); Jorg Sizemore, Duluth, GA (US); John Quentin Cowans, Decatur, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 87 days.

(21) Appl. No.: 15/659,240

(22) Filed: Jul. 25, 2017

(65) Prior Publication Data

US 2019/0035568 A1 Jan. 31, 2019

(51) Int. Cl.

| | |
|---|---|
| ***H01H 13/04*** | (2006.01) |
| ***H01H 9/22*** | (2006.01) |
| ***H01H 71/02*** | (2006.01) |
| ***H01H 71/12*** | (2006.01) |
| *H01H 71/00* | (2006.01) |

(52) U.S. Cl.

CPC ..... *H01H 9/22* (2013.01); *H01H 71/0207* (2013.01); *H01H 71/0264* (2013.01); *H01H 71/126* (2013.01); *H01H 2071/004* (2013.01); *H01H 2071/0292* (2013.01)

(58) Field of Classification Search

CPC ..... H01H 9/20; H01H 73/02; H01F 7/10

USPC ..... 335/202

See application file for complete search history.

(56) References Cited

U.S. PATENT DOCUMENTS

| | | | | | |
|---|---|---|---|---|---|
| 4,710,739 | A * | 12/1987 | Heyne | H01H 71/1054 | 335/167 |
| 4,886,497 | A * | 12/1989 | Scholl, Jr. | A61M 5/002 | 604/111 |
| 5,343,179 | A * | 8/1994 | Pipich | H01H 71/2463 | 335/167 |
| 5,416,455 | A * | 5/1995 | Moldovan | H01H 9/34 | 335/132 |
| 5,635,690 | A * | 6/1997 | Knecht | H01R 13/707 | 200/50.3 |
| 5,808,534 | A * | 9/1998 | Laffey | H01F 7/081 | 335/250 |
| 5,831,503 | A * | 11/1998 | Beck | H01H 71/10 | 335/172 |
| 2010/0164658 | A1* | 7/2010 | Woo | H01H 71/2463 | 335/21 |

(Continued)

*Primary Examiner* — Shawki S Ismail
*Assistant Examiner* — Lisa N Homza

(57) ABSTRACT

A circuit breaker having a housing with an accessory cover includes an accessory cover interlock assembly that trips the circuit breaker upon removal of the accessory cover. The accessory cover interlock assembly includes a plunger rotatable from an initial install position to an engaged position that moves a trip lever into a de-energize position (tripping the circuit breaker) upon removal of the accessory cover. The accessory cover interlock assembly prevents the circuit breaker from being reset while the access cover is removed. The accessory cover interlock assembly automatically resets upon re-attachment of the accessory cover to the circuit breaker housing. Methods of forced safety tripping in a circuit breaker are also provided, as are other aspects.

16 Claims, 9 Drawing Sheets

(56) References Cited

U.S. PATENT DOCUMENTS

2013/0187732 A1* 7/2013 Bullock ..... H01H 33/6661
335/6

* cited by examiner

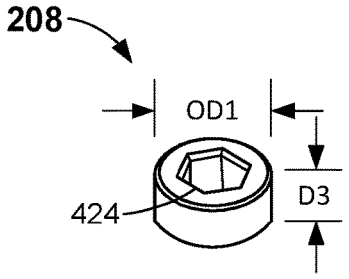
FIG. 4
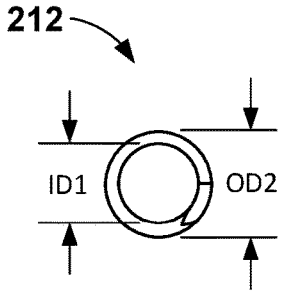
FIG. 5A
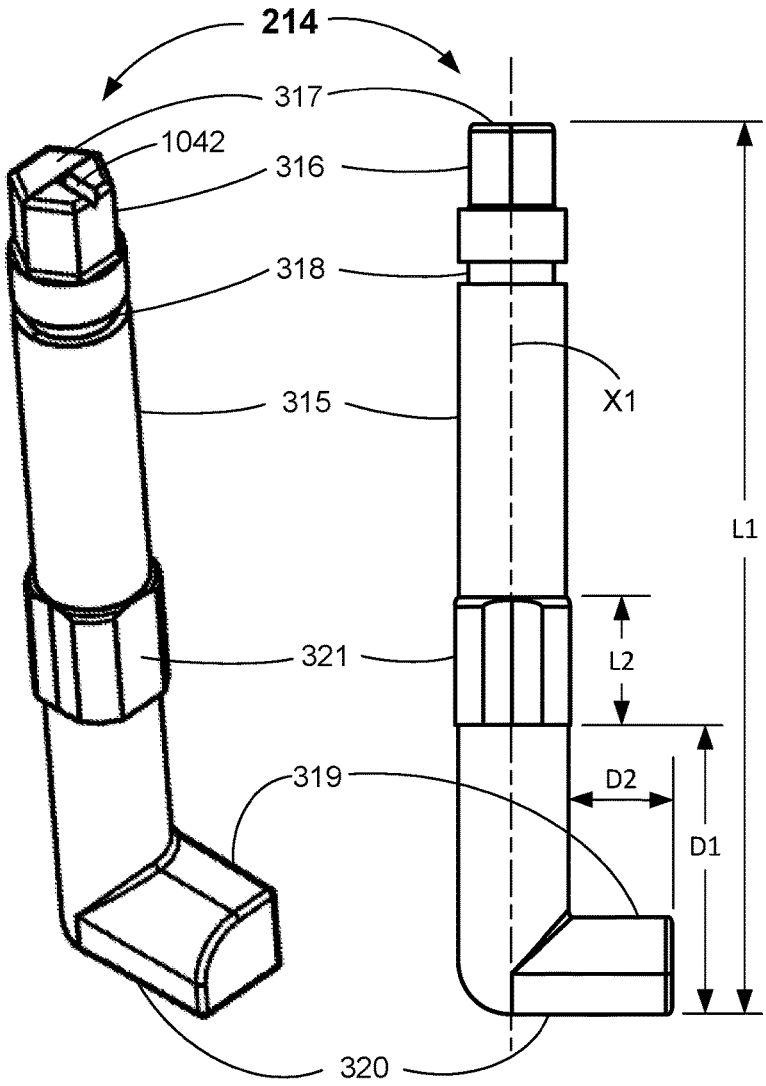
FIG. 3A
FIG. 3B
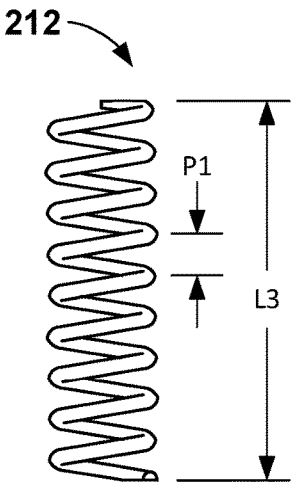
FIG. 5B

CIRCUIT BREAKER ACCESSORY COVER INTERLOCK AND FORCED SAFETY TRIPPING APPARATUS, SYSTEMS, AND METHODS

FIELD

This disclosure relates to circuit breakers having an accessory cover and, more particularly, to an accessory cover interlock that de-energizes (i.e., trips) a circuit breaker upon removal of the accessory cover.

BACKGROUND

Circuit breakers handling currents ranging from, e.g., 800 Amps to 1200 Amps, may have one or more accessory devices, such as, e.g., an under voltage release switch, a trip alarm switch, and/or an early break switch, installed therein that are accessible via removal of an accessory cover on the circuit breaker housing. Removing the accessory cover to service the one or more accessory devices without de-energizing (i.e., tripping) the circuit breaker may expose a user to a dangerous condition. Accordingly, there is a need for apparatus, systems, and methods that automatically de-energize (i.e., trip) a circuit breaker upon removal of an accessory cover and that prevent the circuit breaker from being re-energized (i.e., reset) until the accessory cover is re-attached.

SUMMARY

According to one aspect, an accessory cover interlock assembly for a circuit breaker is provided. The accessory cover interlock assembly includes a plunger having an elongated body, the elongated body having a head at a first end thereof, a foot extending perpendicularly outward from a second end thereof, and a planar lock portion located between the first end and the second end. The accessory cover interlock assembly also includes a retaining member disposed about the elongated body between the first end and the planar lock portion, a spring disposed about the elongated body between the retaining member and the foot, and a cap having an opening, the cap seated on the head of the elongated body.

According to another aspect, a circuit breaker is provided. The circuit breaker includes a housing having an accessory pocket for installing one or more accessory devices therein, an accessory cover removably attached to the housing to enclose the accessory pocket when attached to the housing and to provide access to the accessory pocket when removed from the housing, and a trip lever located inside the housing and movable to and from an energized position and a de-energized position, wherein the circuit breaker is tripped with the trip lever in the de-energized position. The circuit breaker also includes an accessory cover interlock assembly coupled in the housing and in contact with the accessory cover when the accessory cover is attached to the housing. The accessory cover interlock assembly includes a plunger having a longitudinal axis and an elongated body along the longitudinal axis, wherein the plunger is rotatable about the longitudinal axis from an install position to an engaged position. The elongated body has a first end, a second end, and a foot extending perpendicularly outward from the second end wherein, in the engaged position, the foot is positioned beneath the trip lever and is configured to move the trip lever from the energized position to the de-energized position in response to removal of the accessory cover.

According to a further aspect, a method of forced safety tripping in a circuit breaker is provided. The method includes inserting an accessory cover interlock assembly partially into a circuit breaker housing having an accessory cover removed, wherein the accessory cover interlock assembly is installed in an install position and includes a plunger. The plunger has a longitudinal axis and an elongated body along the longitudinal axis, and the elongated body has a first end, a second end, and a foot extending perpendicularly outward from the second end. The method includes rotating the accessory cover interlock assembly about the longitudinal axis from the install position to an engaged position, and attaching the accessory cover to the circuit breaker housing to press the accessory cover interlock assembly into the circuit breaker housing.

Still other aspects, features, and advantages in accordance with these and other embodiments of the disclosure may be readily apparent from the following detailed description, the appended claims, and the accompanying drawings. Accordingly, the drawings and descriptions herein are to be regarded as illustrative in nature, and not as restrictive.

BRIEF DESCRIPTION OF DRAWINGS

The drawings, described below, are for illustrative purposes only and are not necessarily drawn to scale. The drawings are not intended to limit the scope of this disclosure in any way.

FIGS. 3A and 3B illustrate perspective and side views, respectively, of a plunger of an accessory cover interlock assembly according to embodiments.

FIG. 4 illustrates a perspective view of a cap of an accessory cover interlock assembly according to embodiments.

FIGS. 5A and 5B illustrate top and side views, respectively, of a spring of an accessory cover interlock assembly according to embodiments.

DETAILED DESCRIPTION

Figure 1:
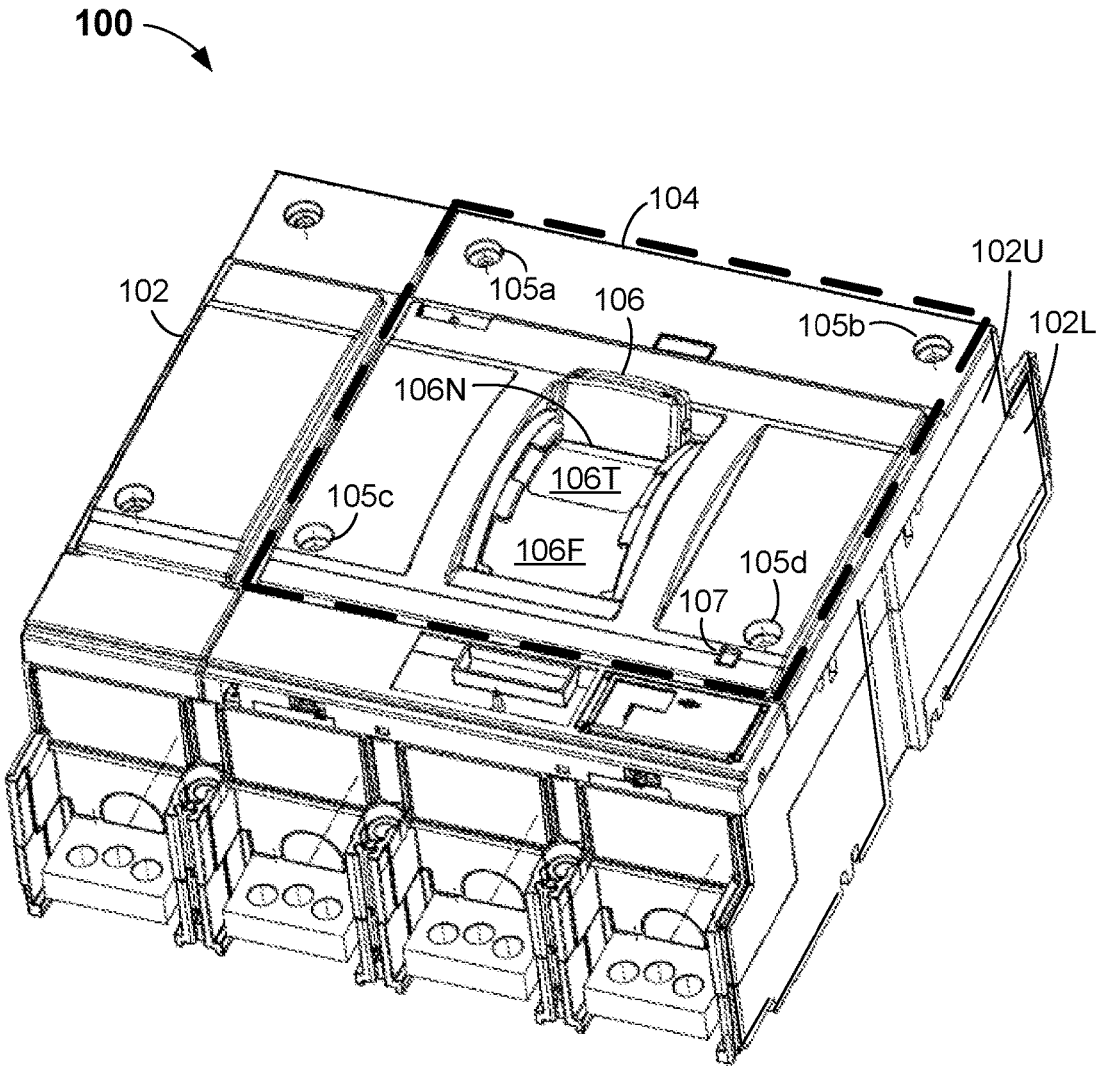
FIG. 1 illustrates a perspective view of a circuit breaker according to embodiments.

Reference will now be made in detail to the example embodiments of this disclosure, which are illustrated in the accompanying drawings. Wherever possible, the same reference numbers will be used throughout the drawings to refer to the same or like parts.

Circuit breakers may be used in industrial applications where voltages may be, e.g., 240 V, 480 V, or 600 V AC, or 250 V DC, and current flowing through such circuit breakers may range from about 800 A to about 2000 A. These circuit breakers may have one or more accessory spaces or pockets within a circuit breaker housing to include accessory devices, such as, e.g., an under voltage release switch, a trip alarm or bell switch, and/or an early break switch. Access to an accessory pocket may be provided by an accessory cover removably attached (e.g., via screws) to the front of the circuit breaker housing. Removal of the accessory cover while the circuit breaker is still energized may expose a user to a dangerous condition, such as, e.g., high voltages/currents at exposed electrical contacts, connectors, and/or conductors in the interior of the circuit breaker.

In one or more aspects, an accessory cover interlock assembly is configured to trip (i.e., de-energize) a circuit breaker in response to removal of an accessory cover from the housing of the circuit breaker. The accessory cover interlock assembly may be easily installed by inserting the accessory cover interlock assembly partially into the circuit breaker housing while the accessory cover is removed. The accessory cover interlock assembly may then be rotated by about 90 degrees (e.g., +/−5 degrees) in some embodiments, while pressing the accessory cover interlock assembly further into the circuit breaker housing to compress a spring of the accessory cover interlock assembly. The accessory cover may then be attached to the circuit breaker housing to set the accessory cover interlock assembly and allow the circuit breaker to be switched to the ON (energized) position. Upon removal of the accessory cover, the accessory cover interlock assembly automatically causes the circuit breaker to trip (i.e., de-energize). While the accessory cover is removed, the accessory cover interlock assembly prevents the circuit breaker from being reset (i.e., switched to the ON position). Upon re-attachment of the accessory cover, the accessory cover interlock assembly is automatically reset, and the circuit breaker can be reset. The accessory cover interlock assembly may also be removed from a circuit breaker without affecting the normal functionality of the circuit breaker in applications where such an automatic accessory cover tripping feature is not needed or desired. The accessory cover interlock assembly may further be installed in some existing circuit breakers with only minor modifications to the circuit breaker accessory cover, housing, and tripping shaft, as described in more detail further below.

In other aspects, methods of forced safety tripping in a circuit breaker are provided, as will be described in more detail below in connection with FIGS. 1-13B.

FIG. 1 illustrates a circuit breaker 100 in accordance with one or more embodiments. Circuit breaker 100 may be coupled between a power source and one or more load circuits (none shown) that are protected by circuit breaker 100. Circuit breaker 100 may be a 4-pole circuit breaker as shown, but may alternatively have other suitable numbers of poles. Circuit breaker 100 may have a housing 102, an accessory cover 104, and a main switch 106. Housing 102 may have one or more accessory pockets therein (not shown in FIG. 1; see accessory pocket 828 in FIG. 8) for installing one or more accessory devices therein. Accessory devices may include one or more switches, such as, e.g., an under voltage release switch; a trip or bell alarm switch, an early break or leading changeover switch, and/or a shunt trip switch. In some embodiments, housing 102 may include an upper housing 102U bolted to a lower housing 102L, wherein upper housing 102U may have one or more accessory pockets therein.

Accessory cover 104 (highlighted in a dashed outline) may be removably attached to housing 102 (or, in some embodiments, to upper housing 102U; collectively referred to hereinafter as housing 102) via, e.g., four screws 105*a-d*. Other attachment mechanisms may be possible. Accessory cover 104 may enclose the one or more accessory pockets when attached to housing 102 and may provide access to the one or more accessory pockets when removed from housing 102.

Main switch 106 may have an ON position 106N, a tripped position 106T, and an OFF position 106F. Circuit breaker 100 may be energized (i.e., configured to couple power from a power source to one or more loads coupled to circuit breaker 100) when main switch 106 is in ON position 106N, as shown in FIG. 1. Main switch 106 in tripped position 106T may indicate that a test or fault condition has caused circuit breaker 100 to trip (i.e., de-energize wherein power is disconnected in the circuit breaker from the one or more load circuits). A test or fault condition may include, e.g., manual activation of a push-to-trip (PTT) button 107, removal of accessory cover 104 as described herein, detection of a short circuit in a load circuit, etc. Main switch 106 in OFF position 106F may indicate that circuit breaker 100 is de-energized (i.e., power is disconnected from the one or more loads), which may occur via a manual switching of main switch 106 to OFF position 106F.

In one or more embodiments, circuit breaker 100 may include one of an ETU (Electronic Trip Unit), or one TMTU (Thermal Magnetic Unit), several subassemblies including various switching mechanisms and crossbar assemblies (none shown), depending on the particular configuration of circuit breaker 100.

Figure 2:
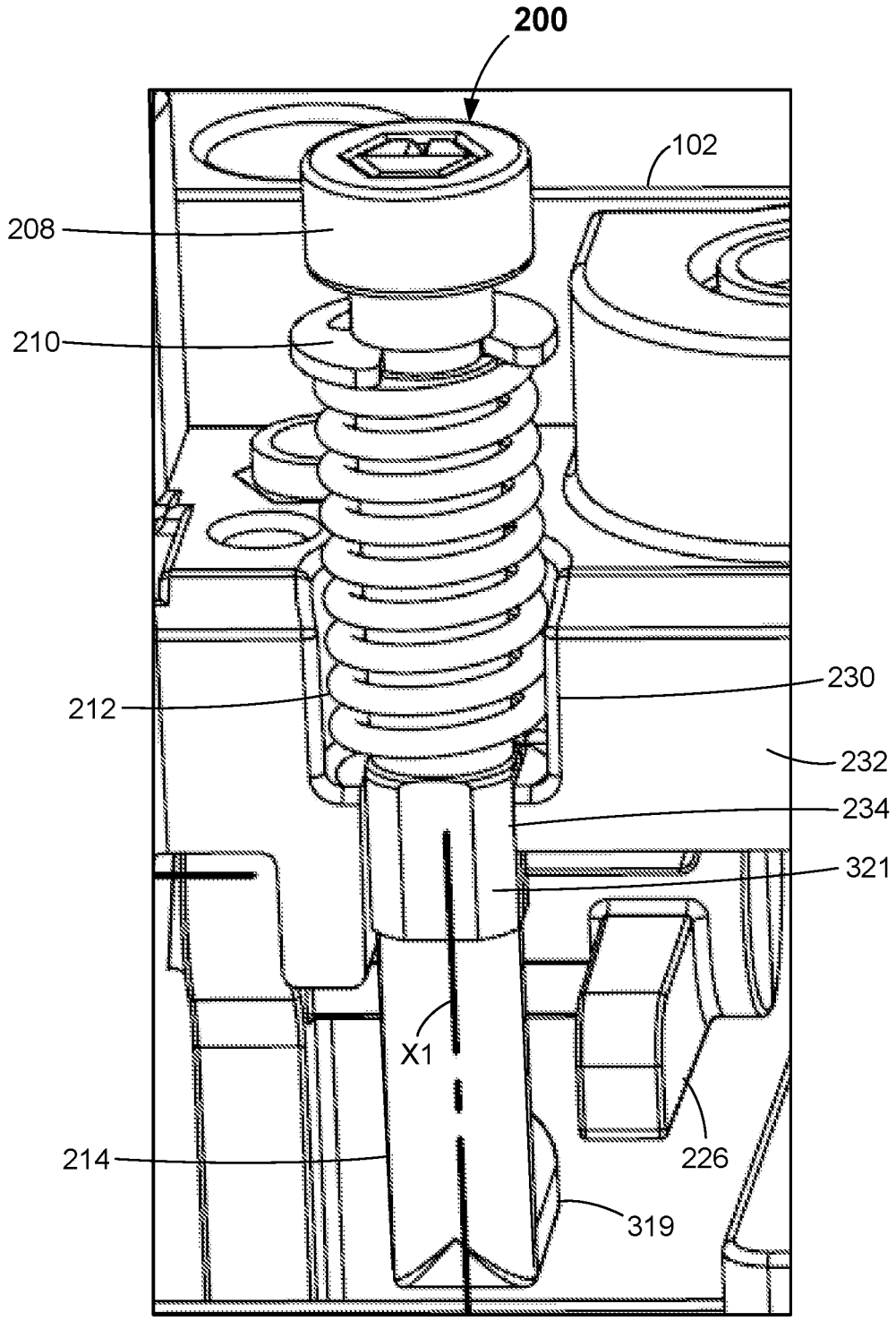
FIG. 2 illustrates a perspective view of an accessory cover interlock assembly in an install position inserted in a housing of a circuit breaker according to embodiments.

FIG. 2 illustrates an accessory cover interlock assembly 200 arranged in an install position after being inserted in housing 102 of circuit breaker 100 in accordance with one or more embodiments. Accessory cover interlock assembly 200 has a longitudinal axis X1 and includes a cap 208, a retaining member 210, a spring 212, and a plunger 214. Plunger 214, which is also shown in FIGS. 3A and 3B, has an elongated body 315 extending along longitudinal axis X1. Elongated body 315 may have a head 316 at a first end 317 thereof, a groove 318 extending about a circumference thereof proximate to head 316, a foot 319 extending perpendicularly outward from a second end 320 thereof, and a planar lock portion 321 located between first end 317 and second end 320. Head 316 may have a hexagonal shape. Other shapes may be possible. Planar lock portion 321 may have two or more planar surfaces. In some embodiments, planar lock portion 321 may have four planar surfaces and may be square shaped. Other planar configurations may be possible. Plunger 214 may be made of any rigid (non-conductive) material such as injection-molded thermoplastics, molded thermosets, or fabricated engineering glass-filled laminates. In some embodiments, metals may be considered for higher tripping forces wherein, e.g., a stainless steel core may be completely over molded in an injection insertion molding process and all pin holes may be sealed in a secondary process to make plunger 214 non-conductive. In some embodiments, plunger 214 has a length L1 that may range from 40.0 mm to 43.0 mm, planar lock portion 321 has a length L2 that may range from 5.0 mm to 7.0 mm that is located a distance D1 from second end 320 that may range from 13.0 mm to 14.0 mm, and foot 319 extends a distance D2 perpendicularly outward from elongated body 315 that may range from 4.0 mm to 8.0 mm or more.

Cap 208, which is also shown in FIG. 4, may have an opening 424 configured to receive head 316. In some embodiments, opening 424 may be hexagonal. Other shapes configured to receive head 316 may be possible. In some embodiments, cap 208 has an outside diameter OD1 that may range from 7.8 mm to 8.2 mm and a depth D3 measured along the length of elongated body 315 that may range from 3.8 mm to 4.2 mm. Cap 208 may be seated on head 316 of elongated body 315.

Retaining member 210 may be disposed about elongated body 315 between first end 317 and planar lock portion 321. Retaining member 210 may be seated and held in place in groove 318 and, in some embodiments, may be a stainless steel type E retaining ring.

Spring 212 may be disposed about elongated body 315 of plunger 214 between first end 317 and foot 319 prior to seating of retaining member 210 in groove 318, between retaining member 210 and foot 319 after seating of retaining member 210 in groove 318, and between retaining member 210 and planar lock portion 321 after insertion of accessory cover interlock assembly 200 into housing 102, as described in more detail below. In some embodiments, spring 212, which is also shown in FIGS. 5A and 5B, may be a stainless steel helical or coil spring having a free (uncompressed) length L3 that may range from 27.0 mm to 29.0 mm, a pitch P1 that may range from 2.8 mm to 3.2 mm, an outside diameter OD2 that may range from 7.5 mm to 8.0 mm, an inside diameter ID1 that may range from 5.5 mm to 6.0 mm, and/or a spring rate that may range from 3.2 N/mm to 3.7 N/mm.

Figure 6:
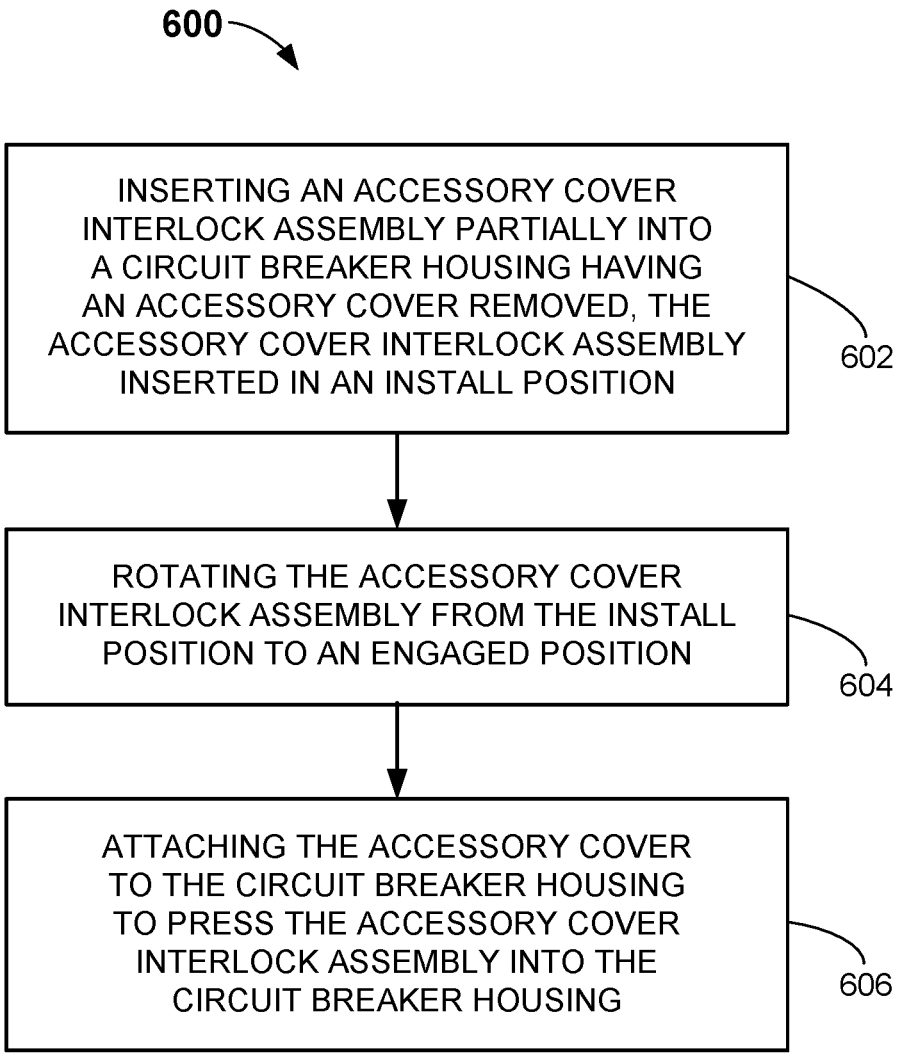
FIG. 6 illustrates a flowchart of a method of forced safety tripping in a circuit breaker according to embodiments.
Figure 7:
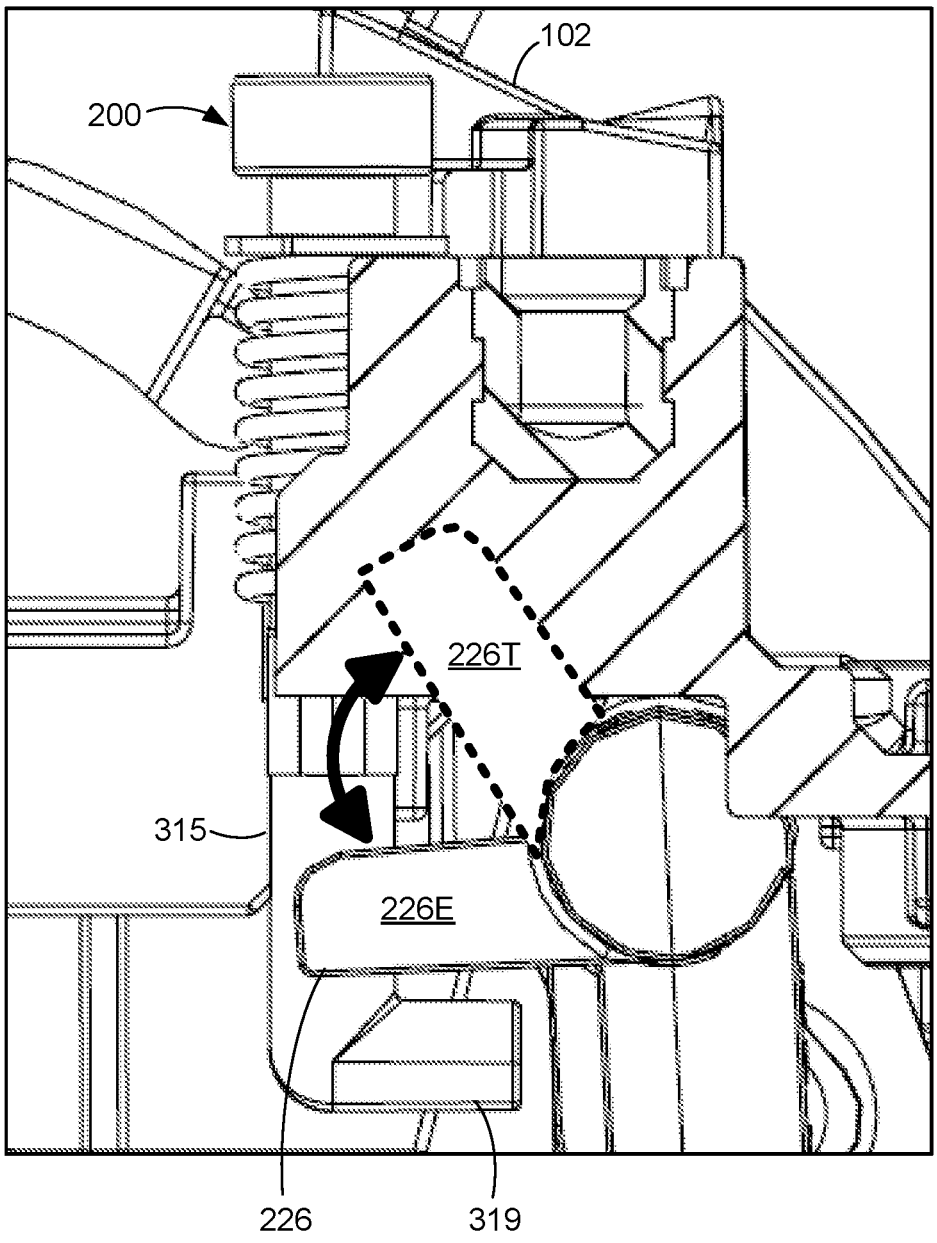
FIG. 7 illustrates a cross-sectional side view of a portion of a circuit breaker housing having an accessory cover interlock assembly in an install position according to embodiments.

FIG. 6 illustrates a flowchart of a method 600 of forced safety tripping in a circuit breaker in accordance with one or more embodiments. Method 600 may include at process block 602 inserting an accessory cover interlock assembly partially into a circuit breaker housing having an accessory cover removed, wherein the accessory cover interlock assembly is inserted in an install position. For example, as shown in FIGS. 2 and 7, accessory cover interlock assembly 200 is arranged in an install position, wherein foot 319 is positioned parallel to and offset from a trip lever 226 of circuit breaker 100. Trip lever 226 is located inside housing 102 and is movable to and from an energized position 226E (as shown in FIGS. 2 and 7) and a de-energized position 226T (shown in phantom in FIGS. 7 and 13B). Moving trip lever 226 into de-energized position 226T causes the circuit breaker to trip. The install position of accessory cover interlock assembly 200 may avoid interference with trip lever 226 during initial insertion of accessory cover interlock assembly 200 into housing 102.

Figure 8:
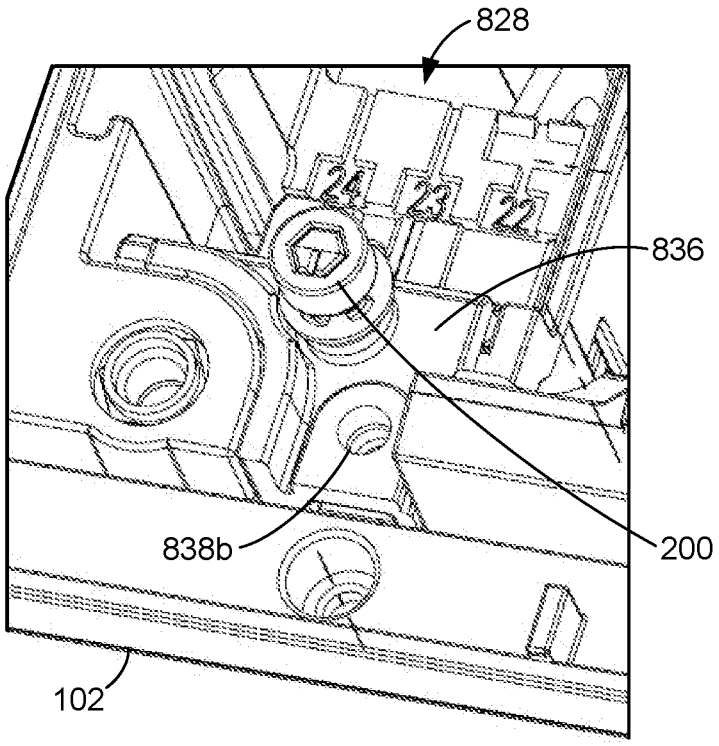
FIG. 8 illustrates a perspective view of a portion of a circuit breaker housing with an accessory cover removed according to embodiments.

With accessory cover 104 removed as shown in FIG. 8, which provides access to accessory pocket 828, accessory cover interlock assembly 200 may be inserted into housing 102 through a cutout 230 in a guide wall 232 of housing 102 (see FIG. 2). Guide wall 232 may have a planar guide 234 located below cutout 230 that is configured to receive planar lock portion 321 therein. Planar guide 234 may have two or more planar surfaces configured to receive corresponding planar surfaces of planar lock portion 321. With planar lock portion 321 received in planar guide 234, accessory cover interlock assembly 200 is prevented from rotating about its longitudinal axis X1.

Figure 9:
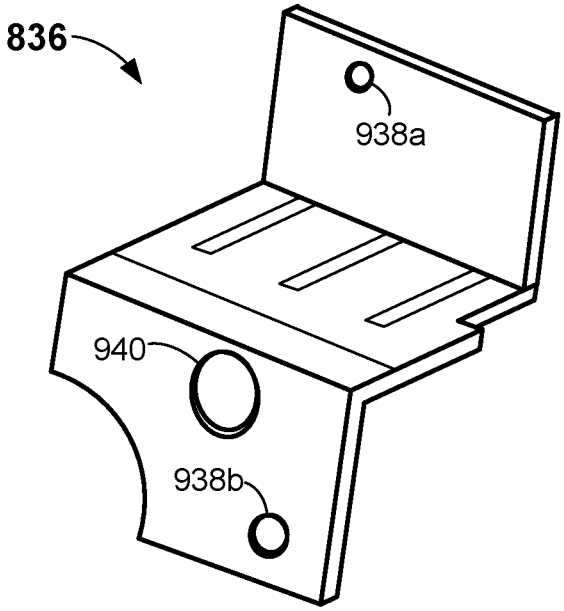
FIG. 9 illustrates a perspective view of a bracket used in a circuit breaker housing according to embodiments.

In some embodiments, as shown in FIGS. 8 and 9, housing 102 may include a bracket 836 attached to housing 102 via, e.g., two screws through respective holes 938*a* and 938*b* (and corresponding hole 838*b* of housing 102; note that housing 102 may also have a hole (not shown) corresponding to hole 938*a*). Bracket 836 may be used to support the installation of one or more accessory devices in accessory pocket 828, and may also be used to help guide the accessory cover interlock assembly 200 into housing 102 via guide hole 940, which is aligned with cutout 230 in guide wall 232 (FIG. 2) and is configured to receive accessory cover interlock assembly 200 there through.

Referring again to FIG. 2, upon insertion of accessory cover interlock assembly 200 arranged in the install position into housing 102, planar lock portion 321 is received in planar guide 234, and spring 212 is seated in cutout 230 between planar lock portion 321 and retaining member 210. Retaining member 210 prevents spring 212 from moving (e.g., upwards) beyond groove 318 toward first end 317 and, together with spring 212, prevents plunger 214 from inserting any further beyond (e.g., below) cutout 230 and planar guide 234 in housing 102.

Figure 10:
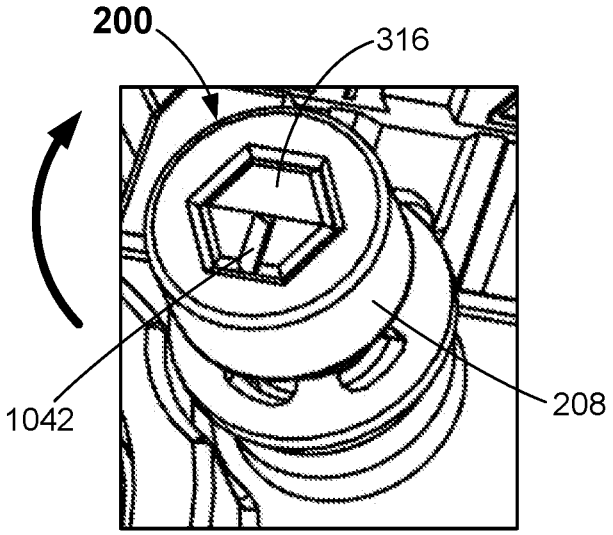
FIG. 10 illustrates an enlarged perspective view of a cap of an accessory cover interlock assembly according to embodiments.

At process block 604, method 600 may include rotating the accessory cover interlock assembly about its longitudinal axis from the install position to an engaged position. For example, as shown in FIG. 10, head 316 may have a slot indicator 1042 that indicates the direction in which foot 319 extends (see also FIG. 3A). In an engaged position, foot 319 is directly under and perpendicular to trip lever 226 when trip lever 226 is set to energized position 226E (FIGS. 7 and 13B). To move accessory cover interlock assembly 200 (and foot 319) from the install position (as shown in FIGS. 2, 7, and 10) to an engaged position, plunger 214 may be manually rotated using, e.g., a 4 mm socket hex driver about longitudinal axis X1 (FIGS. 2 and 3A) by pressing plunger 214 at head 316 further into housing 102 to compress spring 212 such that planar lock portion 321 moves beyond (e.g., below) planar guide 234, which allows plunger 214 to rotate. Plunger 214 may then be manually rotated into the engaged position. Cap 208 may then be installed onto head 316 and plunger 214 may now also be manually rotated via cap 208 by a user's fingers. In some embodiments, cap 208/plunger 214 may be rotated by about 90 degrees (+/−5 degrees). In response to rotating plunger 214 (and accordingly foot 319) into the engaged position, method 600 may then include discontinuing the pressing of plunger 214, which may allow compressed spring 212 to expand and consequently allow planar lock portion 321 to be received (e.g., to move upwards) into planar guide 234 of guide wall 232 of housing 102, thus preventing accessory cover interlock assembly 200 from rotating while in the engaged position.

Figure 11:
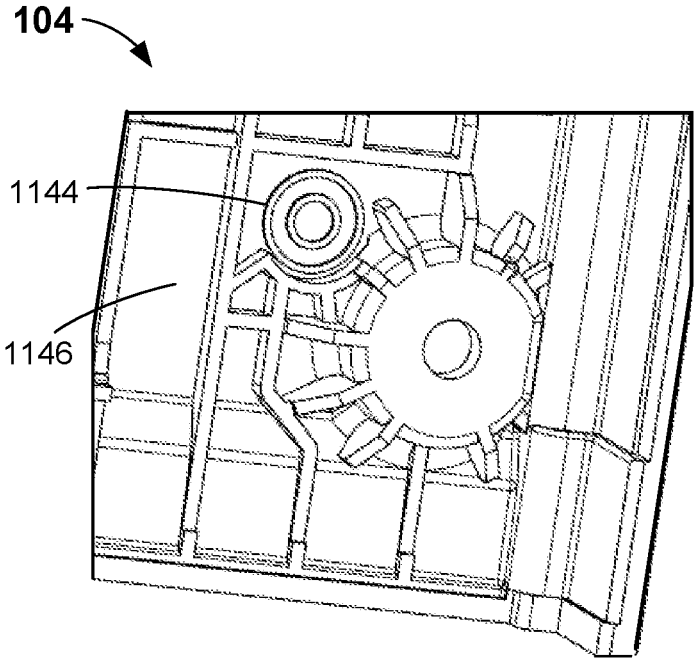
FIG. 11 illustrates a perspective view of a portion of an inside surface of an accessory cover of a circuit breaker according to embodiments.
Figure 12:
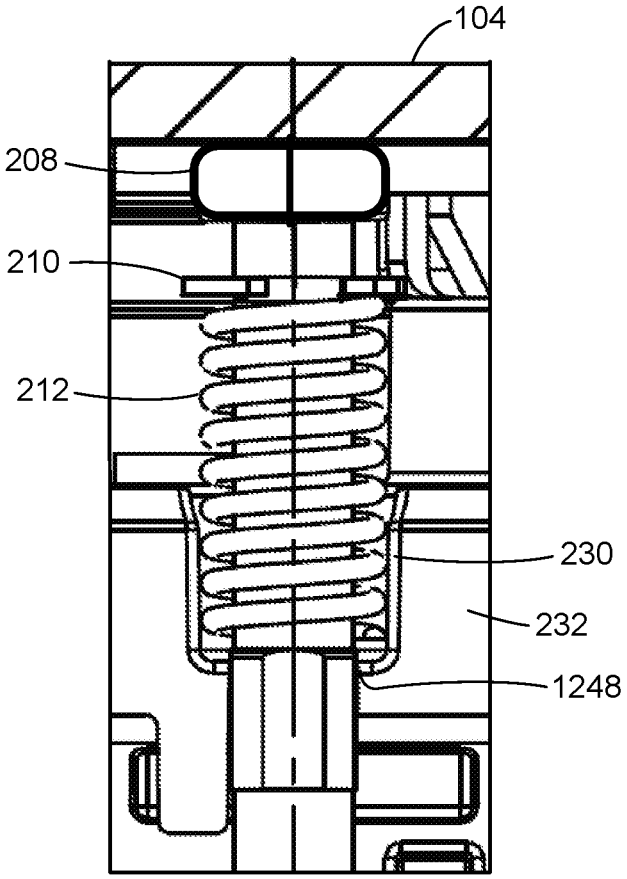
FIG. 12 illustrates a cross-sectional side view of a portion of a circuit breaker housing having an accessory cover attached thereto and an accessory cover interlock assembly inserted therein according to embodiments.

At process block 606, method 600 may include attaching the accessory cover to the circuit breaker housing to press the accessory cover interlock assembly into the circuit breaker housing. Referring to FIGS. 2 and 8, cap 208 of accessory cover interlock assembly 200 may sit in housing 102 at a position such that cap 208 contacts an inside surface of accessory cover 104 as accessory cover 104 is being attached to housing 102. In some embodiments, accessory cover 104 may have a footprint 1144 on an inside surface 1146 of accessory cover 104, as shown in FIG. 11. Footprint 1144 may be aligned with and configured to engage and press against cap 208 in response to attachment of accessory cover 104 to housing 102. As accessory cover 104 is attached to housing 102 (e.g., via driving of screws 105*a-d* (FIG. 1)), accessory cover 104 at footprint 1144 presses accessory cover interlock assembly 200 at cap 208 into housing 102 by compressing spring 212 against retaining member 210 and a bottom surface 1248 of cutout 230 in guide wall 232, as shown in FIG. 12. Once accessory cover 104 has been attached to housing 102, main switch 106 of circuit breaker 100 may be switched into ON position 106N, which moves trip lever 226 into energized position 226E, if not already positioned as such upon initial installation of accessory cover interlock assembly 200 in circuit breaker 100.

Figure 13A:
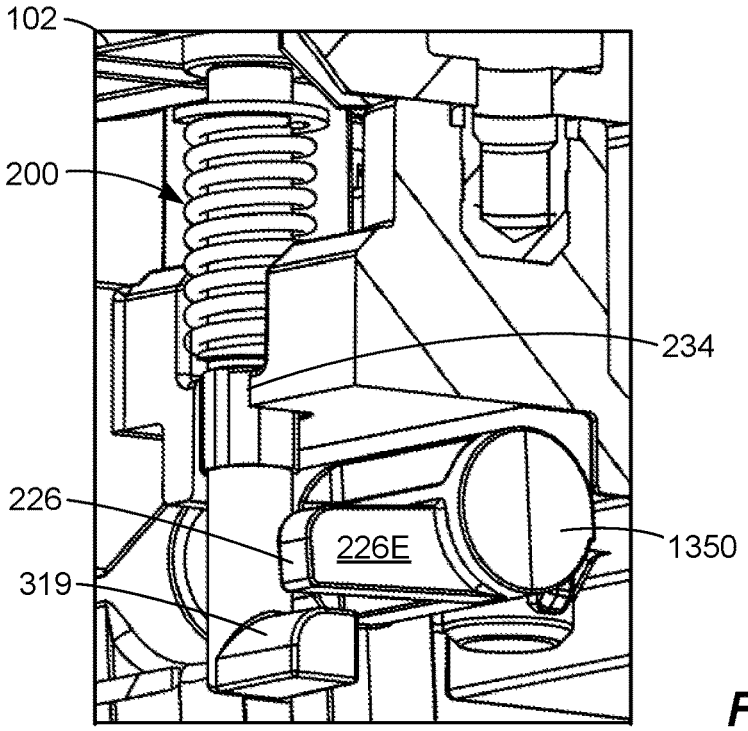
FIGS. 13A and 13B illustrate perspective and side cross-sectional views, respectively, of an accessory cover interlock assembly arranged in an engaged position and inserted in a circuit breaker housing according to embodiments.
Figure 13B:
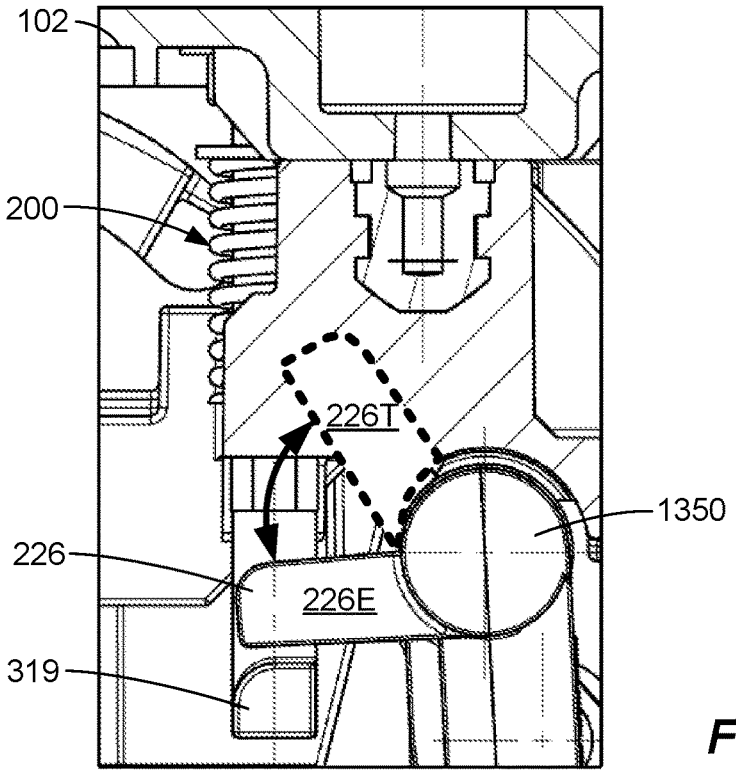

FIGS. 13A and 13B illustrate accessory cover interlock assembly 200 arranged in the engaged position in housing 102 with accessory cover 104 (not shown in FIGS. 13A and 13B) attached in accordance with one or more embodiments. In the engaged position, foot 319 is positioned perpendicularly beneath trip lever 226 and is configured to engage and move trip lever 226 from energized position 226E (as shown) to de-energized position 226T (as shown in phantom in FIG. 13B) in response to removal of accessory cover 104.

In operation, with circuit breaker 100 in ON position 106N and trip lever 226 in energized position 226E (i.e., circuit breaker 100 couples power from a power source to one or more loads coupled to circuit breaker 100), removal of accessory cover 104 from housing 102 results in cap 208 no longer engaging and being pressed into housing 102 by accessory cover 104. This allows compressed spring 212 to expand against retaining member 210 seated in groove 318, which moves plunger 214 towards accessory pocket 828 (FIG. 8) and away from planar guide 234 (e.g., upwards as shown, e.g., in FIGS. 13A and 13B). This moves foot 319 into contact with trip lever 226, which drives trip lever 226 from energized position 226E to the de-energized position 226T, causing circuit breaker 100 to trip (i.e., to disconnect power from one or more loads coupled to circuit breaker 100). As a result, main switch 106 moves into tripped position 106T. Accessory pocket 828 may now be safely accessed.

Advantageously, circuit breaker 100 cannot be reset (i.e., main switch 106 cannot be moved into ON position 106N) while accessory cover 104 remains removed from housing 102. An attempt to move main switch 106 into ON position 106N may result in trip lever 226 engaging and attempting to move foot 319 into the engaged position (and compress spring 212) as trip lever 226 attempts to move from de-energized position 226T to energized position 226E. However, without accessory cover 104 pressing against cap 208 to hold foot 319 in the engaged position with spring 212 in a compressed state, release of main switch 106 may result in foot 319 engaging and moving trip lever 226 back into de-energized position 226T as compressed spring 212 expands into its uncompressed state.

Accordingly, upon re-attachment of accessory cover 104 to housing 102, accessory cover 104 at footprint 1144 (FIG. 11) presses against cap 208 to move foot 319 into the engaged position and holds spring 212 in a compressed state. This allows circuit breaker 100 to be reset by moving main switch 106 into ON position 106N (usually by moving main switch 106 from tripped position 106T first to OFF position 106F and then to ON position 106N). This allows trip lever 226 to return to energized position 226E, which is located perpendicularly above foot 319, as shown in FIGS. 13A and 13B.

Advantageously, accessory cover interlock assembly 200 may be installed in some existing circuit breakers with only a few minor modifications to the circuit breaker accessory cover, housing, and tripping shaft. For example, a circuit breaker housing, which may be, e.g., thermoset molded, may be modified to include a planar guide, such as, e.g., planar guide 234 (FIG. 2), and other appropriate openings configured to receive accessory cover interlock assembly 200 there through. A tripping shaft, such as a tripping shaft 1350 (FIGS. 13A and 13B), may be modified to include a trip lever, such as, e.g., trip lever 226. And an accessory cover may be modified to include a footprint or other suitable structure to press against cap 208. Such minor modifications may allow an existing circuit breaker to include accessory cover interlock assembly 200 to provide forced safety tripping in response to accessory cover removal.

The foregoing description describes only example embodiments of the disclosure. Modifications of the above-disclosed apparatus, systems, and methods may fall within the scope of the disclosure. For example, this disclosure may be applicable to circuit breakers of various breaker voltages, currents, and ratings. Accordingly, while example embodiments of the disclosure have been described, it should be understood that other embodiments may fall within the scope of the disclosure, as defined by the following claims.

What is claimed is:

1. An accessory cover interlock assembly for a circuit breaker, comprising:

a plunger having a longitudinal axis and an elongated body, the elongated body along the longitudinal axis, the plunger rotatable about the longitudinal axis from an install position to an engaged position, the elongated body having a head at a first end thereof, a foot extending perpendicularly outward from a second end thereof, and a planar lock portion located between the first end and the second end, wherein, in the engaged position, the foot is positioned beneath a trip lever and is configured to move the trip lever from an energized position to a de-energized position in response to removal of an accessory cover;

a retaining member disposed about the elongated body between the first end and the planar lock portion;

a spring disposed about the elongated body between the retaining member and the foot; and a cap having an opening, the cap seated on the head of the elongated body, wherein the accessory cover interlock assembly trips a circuit breaker upon removal of the accessory cover, wherein the accessory cover interlock assembly prevents the circuit breaker from being reset while the access cover is removed, and wherein the accessory cover interlock assembly automatically resets upon re-attachment of the accessory cover to the circuit breaker.

2. The accessory cover interlock assembly of claim 1, wherein the elongated body has a groove about a circumference thereof proximate to the head, and the retaining member is held in place in the groove.

3. The accessory cover interlock assembly of claim 1, wherein the spring is a stainless steel coil spring having a free length ranging from 27.0 mm to 29.0 mm and a spring rate ranging from 3.2 N/mm to 3.7 N/mm.

4. The accessory cover interlock assembly of claim 1, wherein the retaining member is a stainless steel type E retaining ring.

5. The accessory cover interlock assembly of claim 1, wherein the cap has an outside diameter ranging from 7.8 mm to 8.2 mm and a depth measured along a length of the elongated body ranging from 3.8 mm to 4.2 mm.

6. An accessory cover interlock assembly for a circuit breaker, comprising:

a plunger having an elongated body, the elongated body having a head at a first end thereof, a foot extending perpendicularly outward from a second end thereof, and a planar lock portion located between the first end and the second end;

a retaining member disposed about the elongated body between the first end and the planar lock portion;

a spring disposed about the elongated body between the retaining member and the foot; and a cap having an opening, the cap seated on the head of the elongated body, wherein the plunger has a length ranging from 40.0 mm to 43.0 mm, the planar lock portion has a length ranging from 5.0 mm to 7.0 mm located a distance from the second end ranging from 13.0 mm to 14.0 mm, and the foot extends a distance perpendicularly outward from the elongated body ranging from 4.0 mm to 8.0 mm.

7. The accessory cover interlock assembly of claim 6, wherein the elongated body has a groove about a circumference thereof proximate to the head, and the retaining member is held in place in the groove.

8. The accessory cover interlock assembly of claim 6, wherein the spring is a stainless steel coil spring having a free length ranging from 27.0 mm to 29.0 mm and a spring rate ranging from 3.2 N/mm to 3.7 N/mm.

9. The accessory cover interlock assembly of claim 6, wherein the retaining member is a stainless steel type E retaining ring.

10. The accessory cover interlock assembly of claim 6, wherein the cap has an outside diameter ranging from 7.8 mm to 8.2 mm and a depth measured along a length of the elongated body ranging from 3.8 mm to 4.2 mm.

11. A method of providing an accessory cover interlock assembly for a circuit breaker, comprising:

providing a plunger having a longitudinal axis and an elongated body, the elongated body along the longitudinal axis, the plunger rotatable about the longitudinal axis from an install position to an engaged position, the elongated body having a head at a first end thereof, a foot extending perpendicularly outward from a second end thereof, and a planar lock portion located between the first end and the second end, wherein, in the engaged position, the foot is positioned beneath a trip lever and is configured to move the trip lever from an energized position to a de-energized position in response to removal of an accessory cover;

providing a retaining member disposed about the elongated body between the first end and the planar lock portion;

providing a spring disposed about the elongated body between the retaining member and the foot; and providing a cap having an opening, the cap seated on the head of the elongated body, wherein the accessory cover interlock assembly trips a circuit breaker upon removal of the accessory cover, wherein the accessory cover interlock assembly prevents the circuit breaker from being reset while the access cover is removed, and wherein the accessory cover interlock assembly automatically resets upon re-attachment of the accessory cover to the circuit breaker.

12. The method of claim 11, wherein the elongated body has a groove about a circumference thereof proximate to the head, and the retaining member is held in place in the groove.

13. The method of claim 11, wherein the plunger has a length ranging from 40.0 mm to 43.0 mm, the planar lock portion has a length ranging from 5.0 mm to 7.0 mm located a distance from the second end ranging from 13.0 mm to 14.0 mm, and the foot extends a distance perpendicularly outward from the elongated body ranging from 4.0 mm to 8.0 mm.

14. The method of claim 11, wherein the spring is a stainless steel coil spring having a free length ranging from 27.0 mm to 29.0 mm and a spring rate ranging from 3.2 N/mm to 3.7 N/mm.

15. The method of claim 11, wherein the retaining member is a stainless steel type E retaining ring.

16. The method of claim 11, wherein the cap has an outside diameter ranging from 7.8 mm to 8.2 mm and a depth measured along a length of the elongated body ranging from 3.8 mm to 4.2 mm.

* * * * *